US007462018B2

(12) United States Patent
Chou

(10) Patent No.: US 7,462,018 B2
(45) Date of Patent: Dec. 9, 2008

(54) AIR COMPRESSOR HAVING STABLE CONFIGURATION

(76) Inventor: Wen San Chou, No. 1-25, Kang Wei Village, An Din Hsiang, Tainan Hsien (TW) 745

( * ) Notice: Subject to any disclaimer, the term of this patent is extended or adjusted under 35 U.S.C. 154(b) by 669 days.

(21) Appl. No.: 10/986,421

(22) Filed: Nov. 10, 2004

(65) Prior Publication Data

US 2005/0063840 A1 Mar. 24, 2005

Related U.S. Application Data

(63) Continuation-in-part of application No. 10/216,590, filed on Aug. 12, 2002, now Pat. No. 6,846,162.

(51) Int. Cl.
*F04B 17/00* (2006.01)
*F04B 35/04* (2006.01)
*F04B 39/10* (2006.01)
*F04B 53/12* (2006.01)

(52) U.S. Cl. ..... 417/415; 417/551

(58) Field of Classification Search ..... 417/415, 417/360, 361, 65, 321, 551
See application file for complete search history.

(56) References Cited

U.S. PATENT DOCUMENTS 5,215,447 A * 6/1993 Wen ..... 417/415
5,655,887 A * 8/1997 Chou ..... 417/63
6,059,542 A * 5/2000 Chou ..... 417/360
6,146,112 A * 11/2000 Chou ..... 417/36
6,200,110 B1 * 3/2001 Chou ..... 417/415
6,280,163 B1 * 8/2001 Chou ..... 417/550
6,315,534 B1 * 11/2001 Chou ..... 417/550
6,551,077 B2 * 4/2003 Chou ..... 417/415
6,655,928 B2 12/2003 Chou ..... 417/360
6,783,333 B2 * 8/2004 Wang ..... 417/307
6,846,162 B2 * 1/2005 Chou ..... 417/63
2002/0141890 A1 * 10/2002 Chou ..... 417/415
2004/0105766 A1 * 6/2004 Chou ..... 417/415

* cited by examiner

*Primary Examiner*—Devon C Kramer
*Assistant Examiner*—Alexander B Comley
(74) *Attorney, Agent, or Firm*—Charles E. Baxley

(57) ABSTRACT

An air compressor includes a supporting base having an arm extended from a plate, and a cylinder housing formed integral with the arm and the plate and having an outlet tube. The cylinder housing includes three or more ducts extended outwardly from the outlet tube and communicating with the outlet tube, for attaching a pressure gauge, a nozzle or other devices. A piston is slidably received in the cylinder housing. A motor is attached to the plate, and includes a spindle extendible through either the lower or the upper portion of the plate, and coupled to the piston with an eccentric member, to move the piston to the cylinder housing in a reciprocating action, in order to generate pressurized air.

1 Claim, 5 Drawing Sheets

AIR COMPRESSOR HAVING STABLE CONFIGURATION

The present invention is a continuous-in-part of U.S patent application Ser. No. 10/216,590, filed 12 Aug. 2002 now U.S. Pat No. 6,846,162, allowed.

BACKGROUND OF THE INVENTION

1. Field of the Invention

The present invention relates to an air compressor, and more particularly to an air compressor having a stable configuration for stably supporting rotatable members, and for allowing a driving motor to be supported on or attached onto a supporting base at different positions, and for allowing the driving motor to be stably coupled to the cylinder housing with a solid supporting base.

2. Description of the Prior Art

Typical air compressors comprise a cylinder attached or secured to a base and having a piston slidably disposed therein, and a motor secured to the base and coupled to the piston of the cylinder for actuating or driving the piston of the cylinder in reciprocating action.

The applicant has developed various kinds of typical air compressors, such as U.S. Pat. No. 6,280,163 to Chou, which may also comprise a motor coupled to a piston of a cylinder with an eccentric member, and the eccentric member will be rotated in a great speed by the motor, in order to drive the cylinders. However, the motor may be attached to a supporting base at a predetermined position only, but may not be attached to the other portions on the supporting base.

U.S. Pat. No. 6,655,928 to Chou discloses another typical air compressor which comprise two motors to be selectively attached to a supporting base at two different positions, to allow two motors of different driving strengths to be selectively attached onto the supporting base, for driving the piston of the cylinder at different rate or speed.

Normally, the piston of the cylinder will be drive in a great speed by the motor via an eccentric member, such that the eccentric members are required to be smoothly secured or supported on the base, and are required to be prevented from being swung or vibrated relative to the supporting base.

However, the cylinder housing is required to be attached onto the supporting base, and the motors are also required to be attached onto the supporting base selectively, such that the coupling between the motors and the cylinder housing may have a good chance to become loose, and such that the motor may have a good chance to swing or vibrate relative to the supporting base.

Furthermore, the typical air compressors may not be used to easily couple to various kinds of facilities that require pressurized air supplied thereto.

The present invention has arisen to mitigate and/or obviate the afore-described disadvantages of the conventional air compressors.

SUMMARY OF THE INVENTION

The primary objective of the present invention is to provide an air compressor including a stable configuration for stably supporting rotatable members on the supporting base, and for allowing the driving motor to be selectively supported on or attached onto a supporting base at different positions.

The other objective of the present invention is to provide an air compressor including a stable and solid supporting base to which the cylinder housing and the driving motor may be solidly attached, and to allow the cylinder housing and the driving motor to be stably and smoothly coupled together.

In accordance with one aspect of the invention, there is provided an air compressor comprising a supporting base including plate having a lower opening and an upper orifice formed therein, and having an arm extended from the plate, and a cylinder housing provided on the arm and formed integral with the arm and the plate, the cylinder housing including a chamber formed therein, the cylinder housing including an outlet tube extended therefrom and having a bore formed therein and communicating with the chamber of the cylinder housing, for receiving pressurized air from the chamber of the cylinder housing, a valve seat provided between the outlet tube and the cylinder housing, the cylinder housing further including a first duct, a second duct, and at least one third duct extended outwardly from the outlet tube and communicating with the bore of the outlet tube, for receiving the pressurized air from the bore of the outlet tube, a pressure gauge attached to the first duct, a nozzle coupled to the second duct, a device attached to the third duct, a piston slidably received in the chamber of the cylinder housing, and having a piston rod extended therefrom, a motor attached to the plate, and including a spindle extendible through either of the lower opening or the upper orifice of the plate, and a coupling device for coupling the piston rod to the spindle of the motor, to allow the piston to be moved relative to the cylinder housing in a reciprocating action, in order to generate pressurized air.

The coupling device includes an eccentric member coupled to the spindle of the motor when the spindle of the motor is extended through the lower opening of the plate, and the eccentric member includes a pin extended therefrom and coupled to the piston rod, to allow the piston to be moved relative to the cylinder housing by the motor via the eccentric member.

The coupling device includes a gear rotatably attached to the plate with a shaft, and having a space formed therein and defined by a peripheral casing, to receive and secure the eccentric member therein.

A spring-biased check valve may further be provided and disposed in the outlet tube and engaged with the valve seat, to limit the pressurized air to flow from the chamber of the cylinder housing into the bore of the outlet tube only, and to prevent the pressurized air from flowing backwardly from the bore of the outlet tube into the chamber of the cylinder housing.

A cap may further be provided and selectively attached to the outlet tube, for blocking the bore of the outlet tube, and for stably retaining the spring-biased check valve within the bore of the outlet tube.

The device may be a safety valve. A relief valve may further be provided and attached to the outlet tube. A lid may further be provided and attached to the third duct, to selectively enclose the third duct.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
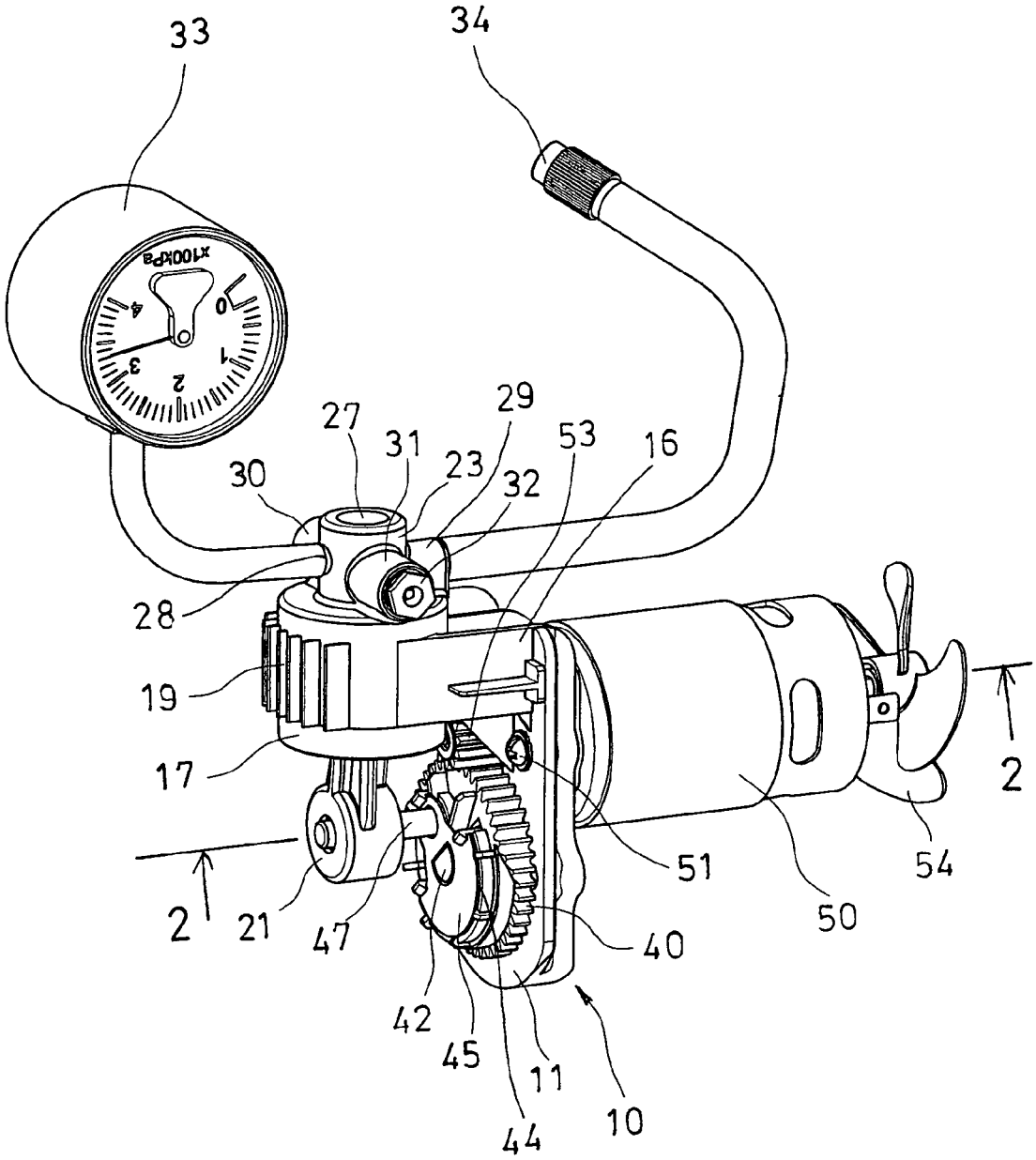
FIG. 1 is a perspective of an air compressor in accordance with the present invention.
Figure 2:
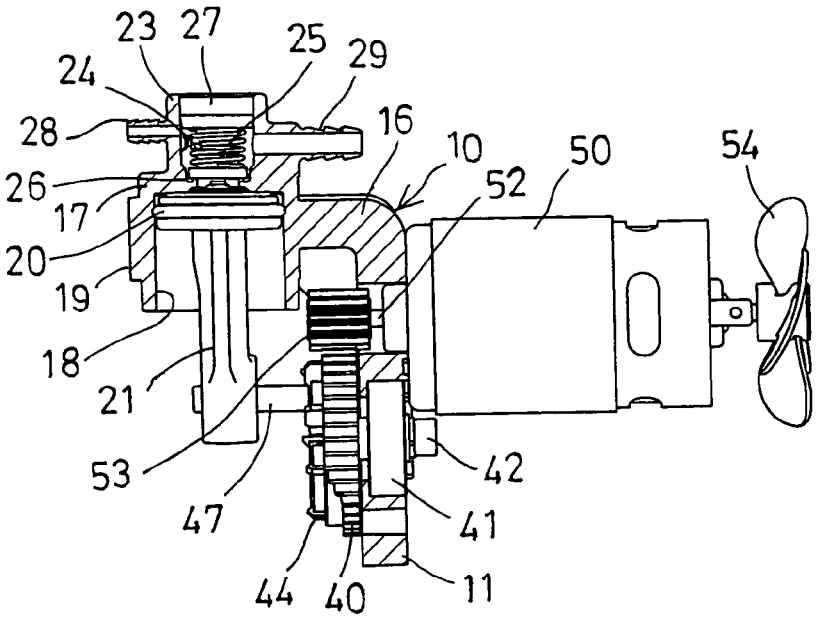
FIG. 2 is a partial cross sectional view of the air compressor, taken along lines 2-2 of FIG. 1.
Figure 3:
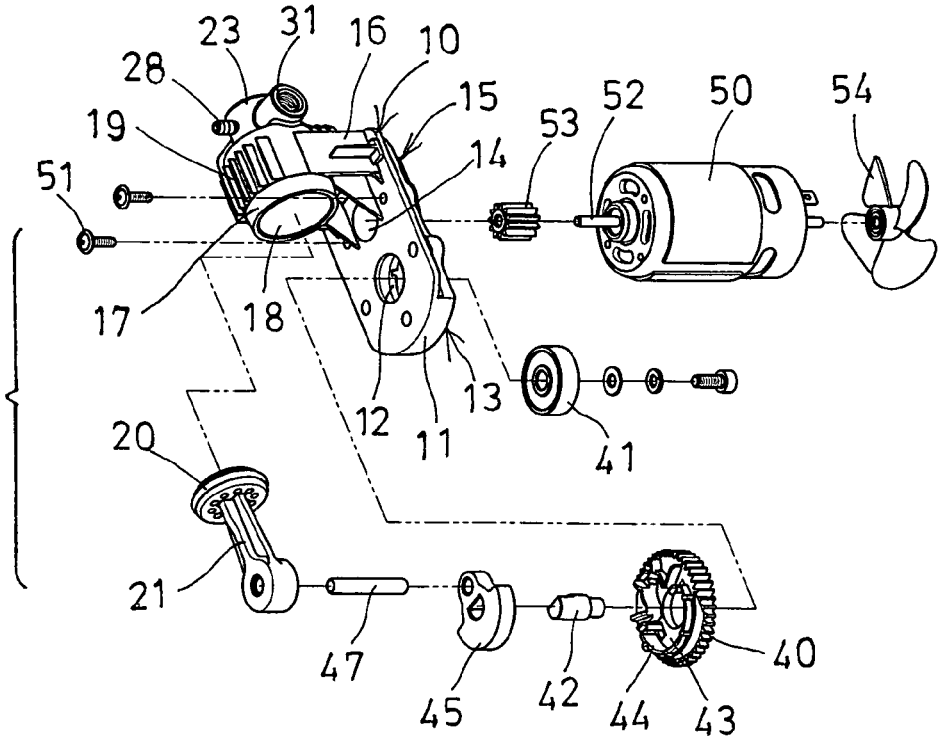
FIG. 3 is a partial exploded view of the air compressor.
Figure 7:
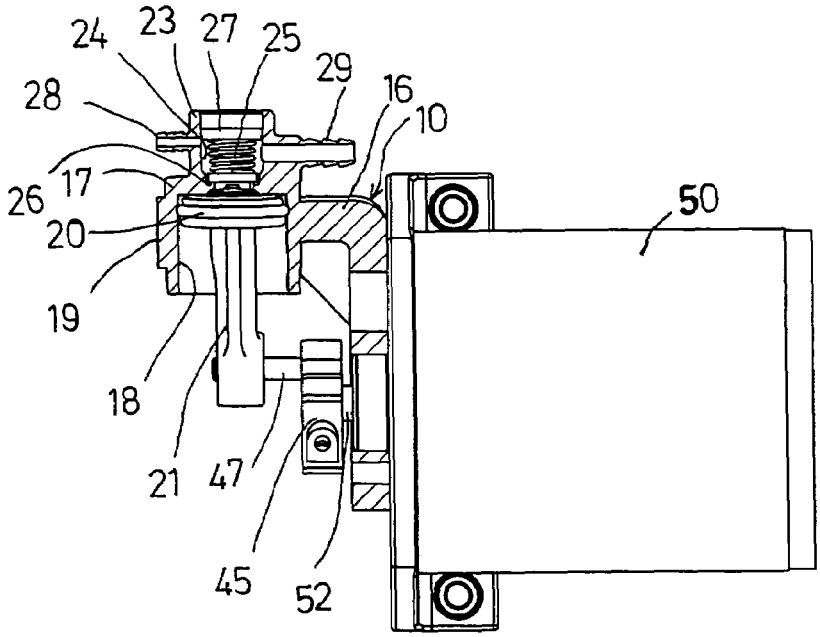
FIG. 7 is a partial cross sectional view of the air compressor, taken along lines 7-7 of FIG. 6.

Referring to the drawings, and initially to FIGS. 1-5, an air compressor in accordance with the present invention comprises a supporting base 10 including a plate 11 having an opening 12 formed in a lower portion 13 thereof, and having an orifice 14 formed in an upper portion 15 thereof, and having an arm 16 laterally extended from the upper portion 15 thereof, and a cylinder housing 17 provided on or extended from the arm 16 and preferably formed integral with the arm 16 and the plate 11, best shown in FIGS. 2 and 7.

The cylinder housing 17 includes a chamber 18 formed therein (FIGS. 2-3, and 7-8), for slidably receiving a piston 20 therein, and includes one or more fins 19 extended laterally or radially outwardly therefrom, for such as heat dissipating purposes. The piston 20 is slidably received in the chamber 18 of the cylinder housing 17, and includes an extension or piston rod 21 extended therefrom, for allowing the piston 20 to slide in reciprocating action in the chamber 18 of the cylinder housing 17, and to generate pressurized air.

The cylinder housing 17 includes an outlet tube 23 extended upwardly or outwardly from the top thereof, and having a bore 24 formed therein and communicating with the chamber 18 of the cylinder housing 17, for receiving the pressurized air from the chamber 18 of the cylinder housing 17. A spring-biased check valve 25 (FIGS. 2, 7) may be disposed in the outlet tube 23, and engaged with a valve seat 26 that is formed or provided between the outlet tube 23 and the cylinder housing 17. A relief valve or safety valve (27) may further be provided and attached to the outlet tube 23, for relieving the pressurized air when the air pressure within the cylinder housing 17 and the outlet tube 23.

The spring-biased check valve 25 may thus be used to limit the pressurized air to flow from the chamber 18 of the cylinder housing 17 into the bore 24 of the outlet tube 23 only, and to prevent the pressurized air from flowing backwardly from the bore 24 of the outlet tube 23 into the chamber 18 of the cylinder housing 17. A cap 27 may be attached to the outer or free end of the outlet tube 23 with such as threading engagements, for blocking or enclosing the bore 24 of the outlet tube 23 only, and for stably retaining the spring-biased check valve 25 within the bore 24 of the outlet tube 23.

The cylinder housing 17 further includes one or more ducts 28, 29, 30, 31 extended outwardly from the outlet tube 23, and communicating with the bore 24 of the outlet tube 23, for receiving the pressurized air from the bore 24 of the outlet tube 23. The ducts 28, 29, 30, 31 may be coupled to various kinds of facilities that require pressurized air supplied thereto. One or more lids 32 (FIGS. 1, 6) may further be provided and attached or secured to either of the ducts 28, 29, 30, 31 with such as threading engagements, for selectively enclosing or blocking the ducts 28, 29, 30, 31, when the ducts 28, 29, 30, 31 are not required to be used.

For example, a pressure gauge 33 may be provided and attached to one of the ducts 28, for detecting and showing the air pressure within the cylinder housing 17 and/or the outlet tube 23. A nozzle 34 may be provided and attached to another duct 29, for allowing the pressurized air to be supplied from the chamber 18 of the cylinder housing 17 and the bore 24 of the outlet tube 23 to various facilities that require pressurized air supplied thereto, with the nozzle 34.

A relief valve or safety valve 35 or other device 35 may further be provided and attached to the other ducts 30, 31, for relieving the pressurized air when the air pressure within the cylinder housing 17 and/or the outlet tube 23 is over a predetermined pressure, and thus for preventing the cylinder housing 17 and/or the outlet tube 23 from being over-pressurized. It is to be noted that the provision or the extension of the ducts 28, 29, 30, 31 from the outlet tube 23 allows the pressure gauge 33 and the nozzle 34 and the relief valve or safety valve 35 to be easily and readily attached to or coupled to the outlet tube 23 with the ducts 28, 29, 30, 31, without additional or specialized coupling members or tools.

A gear 40 is rotatably attached to the plate 11 with a bearing 41 and a shaft 42, in which the bearing 41 may be received in the lower opening 12 of the plate 11. The gear 40 includes a space 43 formed therein and defined by a peripheral casing 44 for receiving and securing an eccentric member 45 therein. The eccentric member 45 may be secured to the gear 40 with such as fasteners (not shown) and may thus be rotated in concert with the gear 40, and includes a crank or an eccentric pin 47 extended therefrom and coupled to the piston rod 21 of the piston 20, in order to actuate or to move the piston 20 relative to the cylinder housing 17 in reciprocating actions.

A motor 50 may be attached or secured to the plate 11 with such as fasteners 51, and includes a spindle 52 extended through the upper orifice 14 of the plate 11 (FIG. 2), and includes a pinion 53 secured to the spindle 52 thereof, and engaged with the gear 40, for allowing the gear 40 to be rotated or driven by the motor 50 via the pinion 53, and thus for allowing the piston 20 to be actuated or moved relative to the cylinder housing 17 in reciprocating actions by the eccentric member 45 and the eccentric pin 47. A fan device 54 may further be provided and coupled to the motor 50 for being rotated or driven by the motor 50 to generate circulating or ventilating air.

Figure 5:
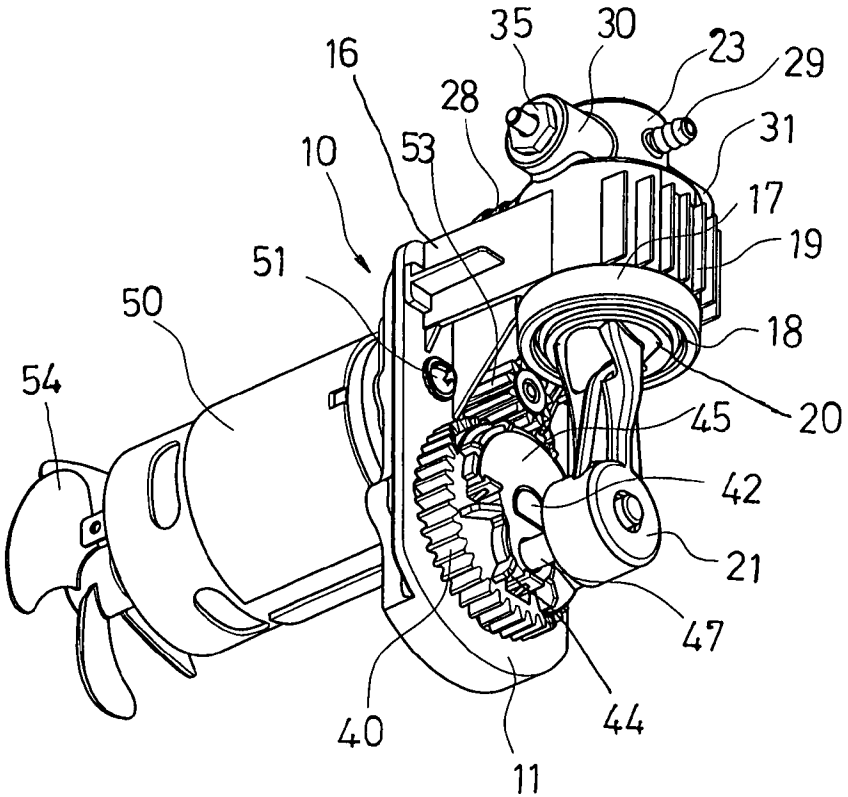
FIG. 5 is a perspective view of the air compressor, as seen from a direction different from that shown in FIG. 1.
Figure 4:
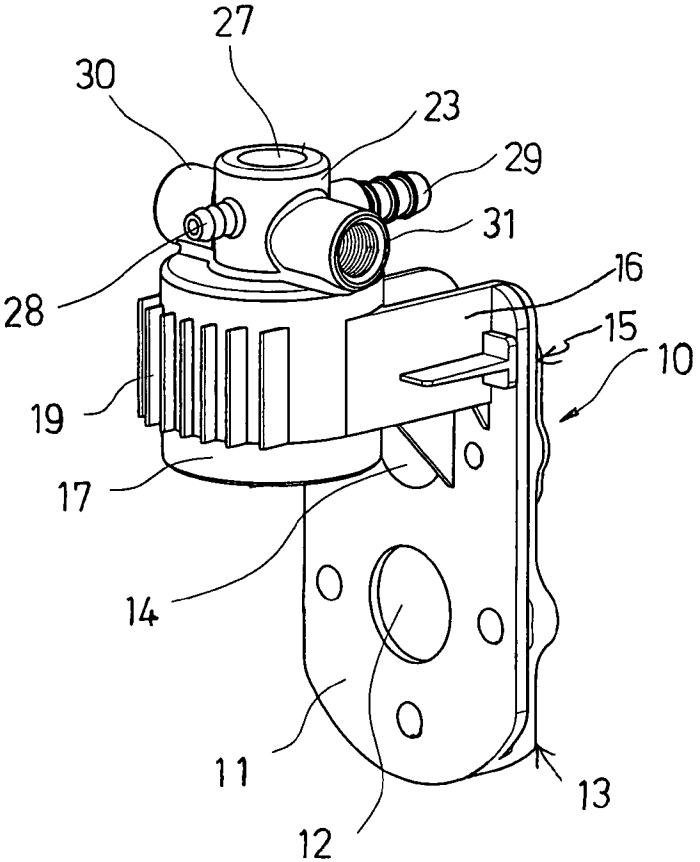
FIG. 4 is an enlarged perspective view illustrating a supporting base for the air compressor.

In operation, as shown in FIGS. 1, 2, and 5, the piston 20 may be actuated or moved relative to the cylinder housing 17 in reciprocating actions by the motor 50 via pinion 53, the gear 40, the eccentric member 45 and the eccentric pin 47, in order to generate a pressurized air, and to allow the pressurized air to flow into the outlet tube 23, and then to flow out through either or all of the ducts 28, 29, 30, 31, and thus to allow the air pressure within the cylinder housing 17 and/or the outlet tube 23 to be detected and shown by the pressure gauge 33, and to allow the pressurized air to be supplied into the facilities that require pressurized air supplied thereto, with the nozzle 34, and/or to the pressurized air to be relieved via the relief valve or safety valve 35 when the cylinder housing 17 and/or the outlet tube 23 is over-pressurized.

Figure 6:
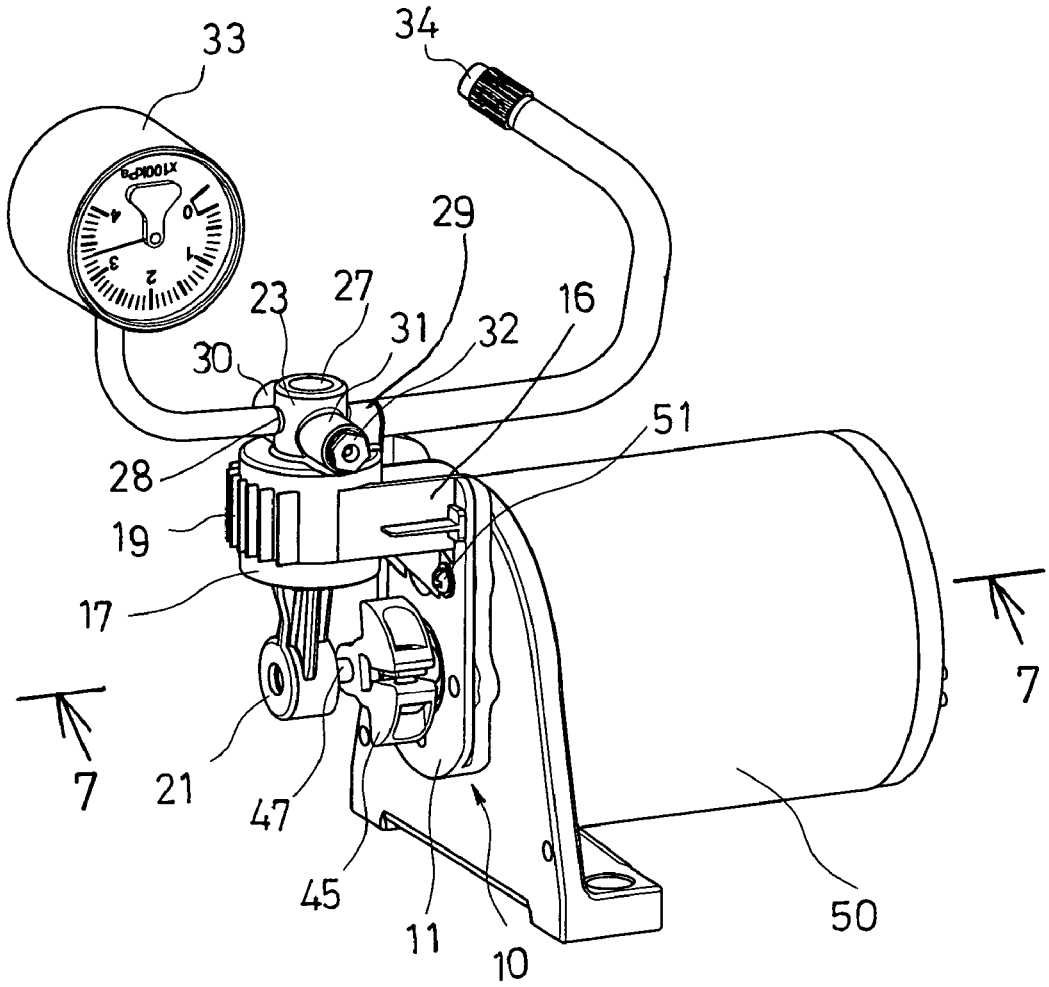
FIG. 6 is a perspective view illustrating the other arrangement of the air compressor.
Figure 8:
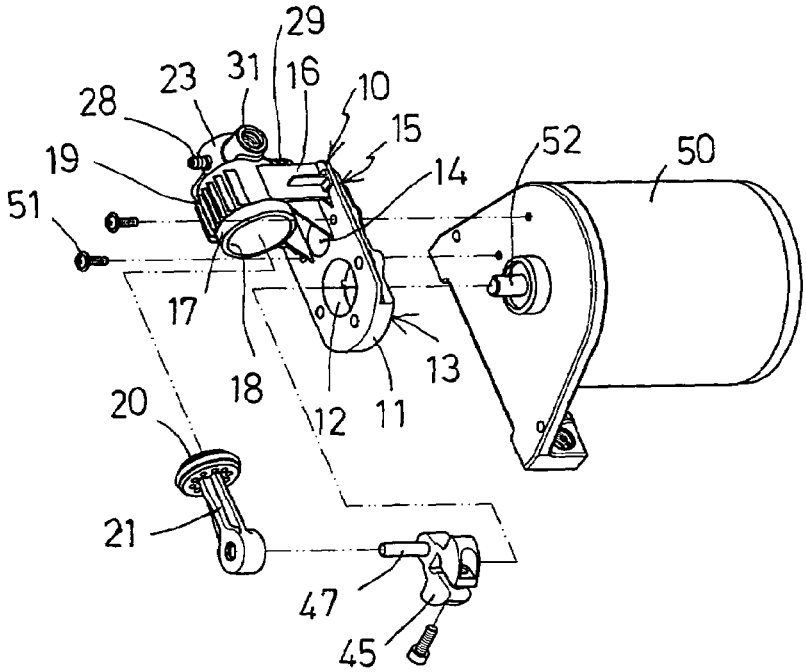
FIG. 8 is a partial exploded view illustrating the arrangement of the air compressor as shown in FIGS. 6 and 7.

As shown in FIGS. 6-8, the spindle 52 of the motor 50 may be alternatively or directly extended through the lower opening 12 of the plate 11, and the motor 50 may also be attached or secured to the plate 11 with such as fasteners 51. In addition, the spindle 52 of the motor 50 may also be directly engaged through and secured to the eccentric member 45, without the gear 40 and the pinion 53, to allow the motor 50 to drive or to move the piston 20 is greater driving forces. The motor 50 or other motors 50 may thus be selectively or changeably supported on or attached onto the plate 11 of the supporting base 10 at different positions, in order to drive or to move the piston 20 in different speed relative to the cylinder housing 17 and in reciprocating actions.

It is to be noted that the cylinder housing 17 is provided on or extended from the arm 16 and formed integral with the arm 16 and the plate 11, such that the cylinder housing 17 will not be become loose from or relative to the plate 11. In addition, the motors 50 may be changeably supported on or attached onto the plate 11 of the supporting base 10 at different positions, and may be readily coupled to the piston 20, to drive or to move the piston 20 in different speed relative to the cylinder housing 17.

Accordingly, the air compressor in accordance with the present invention includes a stable configuration for stably supporting rotatable members on the supporting base, and for allowing the driving motor to be selectively supported on or attached onto a supporting base at different positions, and includes a stable and solid supporting base to which the cylinder housing and the driving motor may be solidly attached, and to allow the cylinder housing and the driving motor to be stably and smoothly coupled together.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An air compressor comprising:

a supporting base including a plate having a lower opening and an upper orifice formed therein, and having an arm extended from said plate, and a cylinder housing provided on said arm and formed integral with said arm and said plate, said cylinder housing including a chamber formed therein, said cylinder housing including an outlet tube extended therefrom and having a bore formed therein and communicating with said chamber of said cylinder housing, for receiving pressurized air from said chamber of said cylinder housing, a valve seat provided between said outlet tube and said cylinder housing, said cylinder housing further including a first duct, a second duct, and at least one third duct extended outwardly from said outlet tube and communicating with said bore of said outlet tube, for receiving the pressurized air from said bore of said outlet tube, a pressure gauge attached to said first duct, a nozzle coupled to said second duct, a safety valve attached to said at least one third duct, a spring-biased check valve disposed in said outlet tube and engaged with said valve seat to limit the pressurized air to flow from said chamber of said cylinder housing into said bore of said outlet tube only, and to prevent the pressurized air from flowing backwardly from said bore of said outlet tube into said chamber of said cylinder housing, a cap selectively attached to said outlet tube for blocking said bore of said outlet tube and for stably retaining said spring-biased check valve within said bore of said outlet tube, a piston slidably received in said chamber of said cylinder housing, and having a piston rod extended therefrom, a motor attached to said plate, and including a spindle extendible through either of said lower opening or said upper orifice of said plate, an eccentric member coupled to said spindle of said motor when said spindle of said motor is extended through said lower opening of said plate, and said eccentric member including a pin extended therefrom and coupled to said piston rod to allow said piston to be moved relative to said cylinder housing in a reciprocating action by said motor and said eccentric member in order to generate the pressurized air, and a gear rotatably attached to said plate with a shaft and having a space formed therein and defined by a peripheral casing to receive and secure said eccentric member in said space of said peripheral casing of said gear.

* * * * *